United States Patent [19]

von Erichsen

[11] Patent Number: 5,002,121

[45] Date of Patent: Mar. 26, 1991

[54] DEVICE AT THE OUTPUT SIDE OF A GAS TURBINE

[75] Inventor: Volker von Erichsen, Recklinghausen, Fed. Rep. of Germany

[73] Assignee: Stober + Morlock Wärmekraft Gesellschaft mbH, Recklinghausen, Fed. Rep. of Germany

[21] Appl. No.: 403,651

[22] Filed: Sep. 6, 1989

[30] Foreign Application Priority Data

Sep. 13, 1988 [DE] Fed. Rep. of Germany ..... 3831062

[51] Int. Cl.[5] ..... F28F 27/02; F24F 7/007; F16K 1/18;

[52] U.S. Cl. ..... 165/100; 165/103; 60/694; 98/39.1; 137/875

[58] Field of Search ..... 98/39.1, 40.01, 41.1; 165/100, 101, 103; 60/39.5, 39.511, 694, 697; 137/875, 883

[56] References Cited

U.S. PATENT DOCUMENTS

| | | | |
|---|---|---|---|
| 1,637,681 | 8/1927 | Clarkson | 165/103 |
| 3,147,773 | 9/1964 | Matthews et al. | 137/875 |
| 3,270,775 | 9/1966 | Alderson | 137/875 |
| 3,837,411 | 9/1974 | Nash et al. | 137/875 |
| 3,897,773 | 8/1975 | Burt et al. | 137/875 |
| 4,821,507 | 4/1989 | Bachmann et al. | 137/875 |

*Primary Examiner*—John Rivell
*Assistant Examiner*—L. R. Leo
*Attorney, Agent, or Firm*—Toren, McGeady & Associates

[57] ABSTRACT

A duct leading to a bypass and a duct leading to a heat exchanger are arranged at the output side of the gas turbine. The two ducts can be closed alternately by flaps. Pivotable guide plates are arranged in the branching area of the two ducts. The guide plates are pivoted by linkages connected to the flaps in the duct leading to the heat exchanger, so that, when the flaps in the bypass are open, the guide plates are inclined relative to the flow of combustion gases and deflect the flow into the duct leading to the bypass. When the flaps in the duct leading to the bypass are closed, the guide plates are pivoted to extend parallel to the flow of combustion gases. In this position, the guide plates do not provide any resistance to the flow of combustion gases to the heat exchanger.

3 Claims, 2 Drawing Sheets

DEVICE AT THE OUTPUT SIDE OF A GAS TURBINE

BACKGROUND OF THE INVENTION

1. Field of the Invention

The present invention relates to a device at the output side of a gas turbine for conducting the combustion gases to a heat exchanger or into a bypass. The device includes guide surfaces arranged in the branching area between the heat exchanger and the bypass.

2. Description of the Related Art

The operation of gas turbines which are followed by a heat exchanger usually requires during start-up of the gas turbine that the heat exchanger is bypassed by means of a bypass. Flap valves are used for optionally guiding the combustion gases to the heat exchanger or to the bypass. These flap valves are arranged in the duct leading to the heat exchanger which duct extends in the flow direction of the combustion gases and the flap valves are arranged in the duct leading to the bypass which duct extends perpendicularly to the flow direction of the combustion gases. These ducts have extremely large cross-sectional areas, for example 20 square meters or more.

The result obtained from the operation of these devices are not satisfactory. The flaps which are closed during the bypass operation and lead to the heat exchanger begin to leak after a very short time and the flaps are frequently damaged until they are destroyed. A reason for this is that the hot combustion gases impact directly on the closed flap with high kinetic energy. In addition, a pulsation occurs in the combustion gases which has a low vibration frequency and substantially contribute to rendering the flaps prematurely useless.

In another known arrangement, the combustion gases are not conducted along a straight line from the gas turbine to the heat exchanger. Rather, to the horizontal ducts at the output side of gas turbine is connected a perpendicularly extending duct portion to which, in turn, are connected a horizontally extending duct which leads to the heat exchanger and a duct which extends in perpendicular direction and leads to the bypass. Stationary guide surfaces are arranged in the deflection region between the horizontally extending ducts from the gas turbine and the perpendicularly extending portion. These guide surfaces facilitate the deflection of the horizontally arriving flow of the combustion gases into an approximately perpendicularly extending direction.

The arrangement described above also has significant disadvantages. The guide surfaces are continuously subjected, i.e., during the start-up as well as during the continuous operation with the heat exchanger, to the pressure of the hot combustion gases and, thus, the guide surfaces wear quickly. The heat exchanger cannot be arranged in the same plane as the gas turbine, but rather the heat exchanger must be raised relative to the gas turbine. Accordingly, the heat exchanger requires an extensive substructure and a greater height of the building in which the unit is set up than is necessary normally. Finally, the guide surfaces constitute a significant resistance to the flow of the combustion gases from the gas turbine. This resistance is continuous, i.e., it does not only occur during the start-up of the turbine.

It is, therefore, the primary object of the present invention to provide a device of the above-described type which is simple and inexpensively avoids the above-mentioned problems.

SUMMARY OF THE INVENTION

In accordance with the present invention, in a device at the output side of a gas turbine for conducting the combustion gases into ducts leading to a heat exchanger or a bypass with guide surfaces arranged in the branch area of the ducts leading to the heat exchanger and to the bypass, the guide surfaces are formed by guide plates or baffle plates which are arranged in the deflection area, wherein the guide plates can be pivoted between a position in which the guide plates extend in longitudinal direction of the flow of combustion gases from the gas turbine to the heat exchanger and a position which is inclined relative to the former position.

In the device according to the present invention, the flow of the combustion gases is directed against the guide plates only during the relatively short bypass operation during the start of the turbine. During the continuous operation with the heat exchanger, on the other hand, the flow of combustion gases does not act on the guide plates.

In accordance with a preferred embodiment of the device of the present invention, the drive of the pivotable guide plates is dependent on the drive of the tank flap leading to the heat exchanger. In this embodiment, when the flaps leading to the heat exchanger are open, the guide plates are moved into a position in which they are parallel to the flow of the combustion gases and in which they offer practically no resistance to the flow. During the bypass operation, i.e., when the tank flaps are closed, the guide plates are pivoted against the flow of the combustion gases and deflect this flow in the direction towards the open bypass flap.

In accordance with another embodiment, the drive of the pivotable guide plates is dependent on the drive of the exhaust flaps leading to the bypass.

In accordance with a particularly useful feature, the guide plates of the device of the present invention are pivoted by means of a linkage (guide plate linkage) which is connected to the heat exchanger flaps or the drive linkage therefor through one or more connecting linkages.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
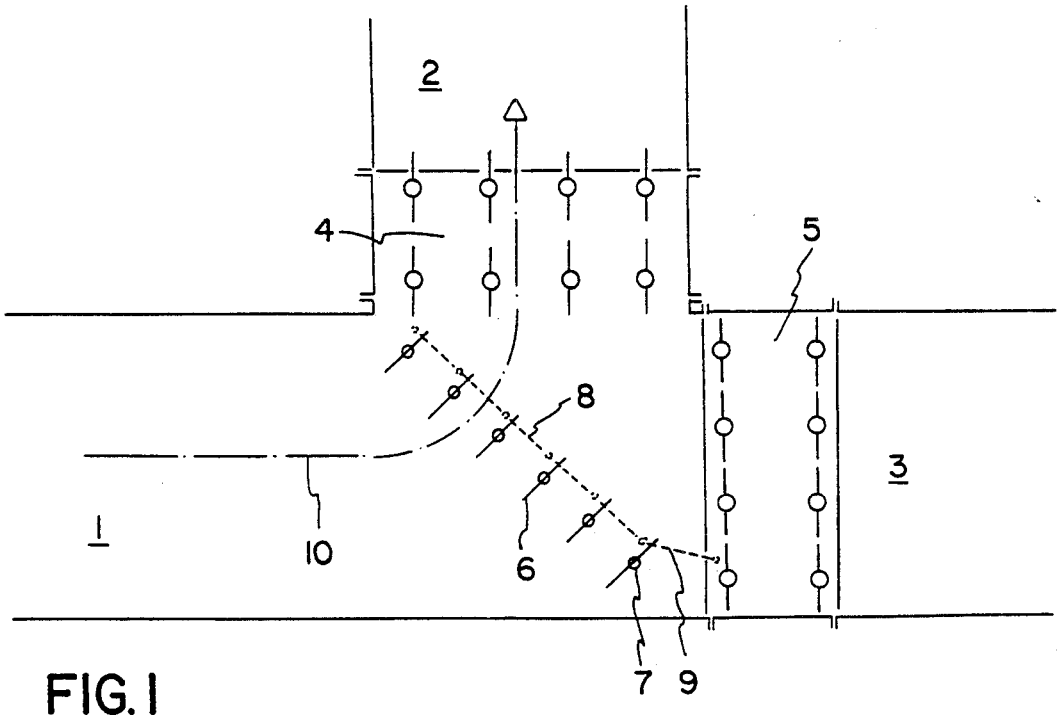
FIG. 1 schematically illustrates the ducts at the output side of a gas turbine with flaps and guide plates arranged in the ducts in the position for bypass operation.
Figure 2:
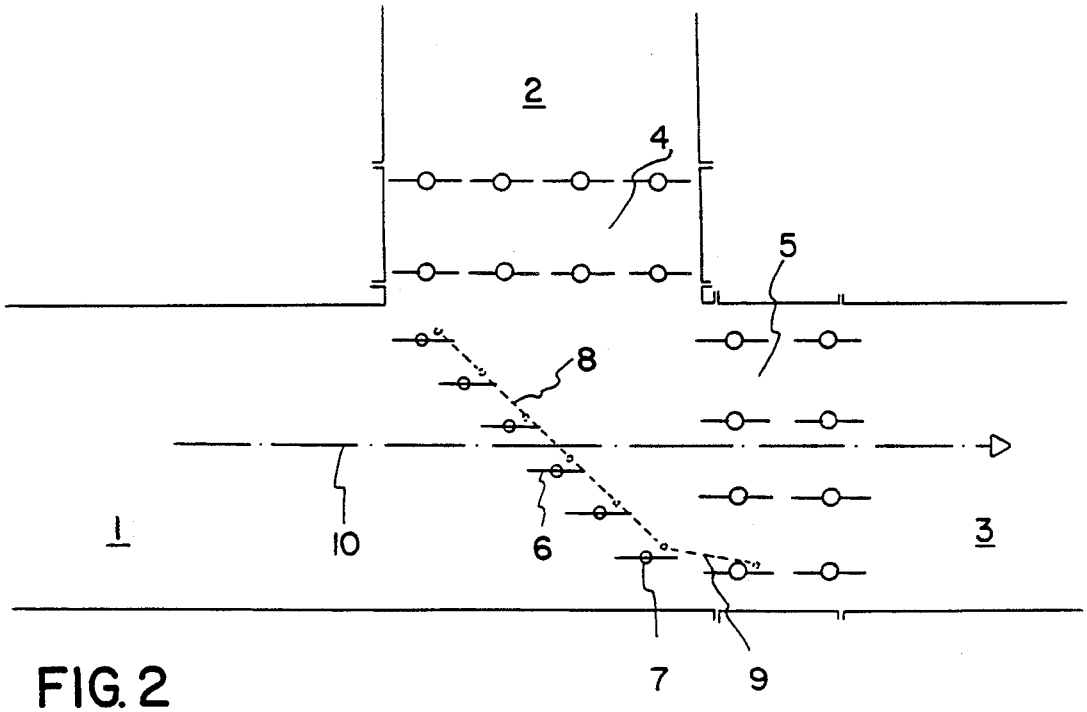
FIG. 2 is same illustration as FIG. 1, except that the flaps and guide plates are in the position for heat exchanger operation.

In FIGS. 1 and 2 of the drawing, the duct at the output side of the gas turbine is denoted by reference numeral 1, the duct leading to the bypass is denoted by reference numeral 2 and the duct leading to the heat exchanger is denoted by reference numeral 3. The bypass flaps arranged in the duct 2 leading to the bypass are in their totality denoted by reference numeral 4, while the heat exchanger flaps arranged in the duct 3 leading to the heat exchanger are in their totality denoted by reference number 5.

In the illustrated embodiment, two rows of four two-bladed flaps each are arranged in each duct, so that the ducts are particularly effectively sealed when the flaps are closed and blocking air can be introduced between the two rows of flaps.

Pivotable guide plates 6 are arranged in the region in which the duct 2 branches off from the ducts 1 and 3. The individual guide plates 6 are of the type of symmetrical rotary flaps and are pivotable about axes 7.

Figure 3:
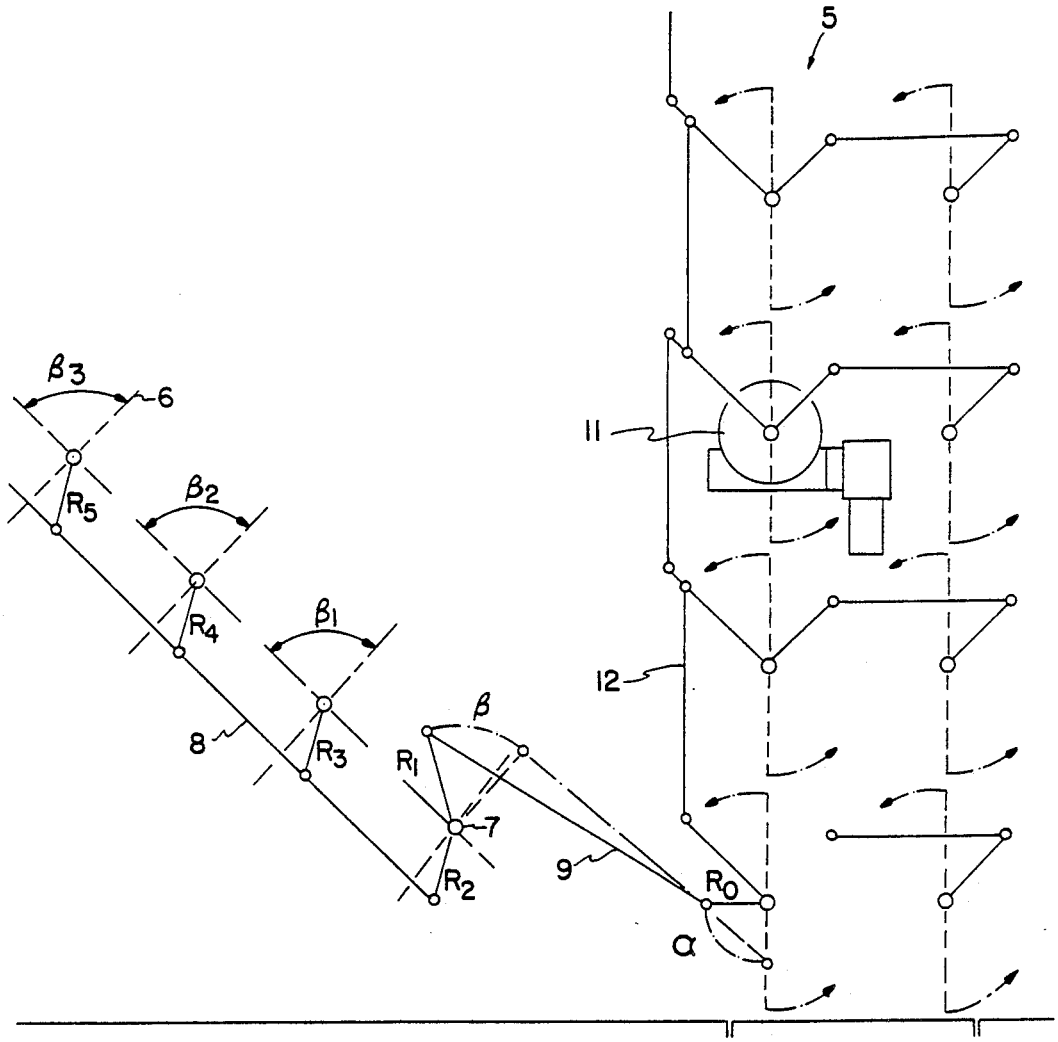
FIG. 3 schematically illustrates linkages for operating the guide plates in dependence on the drive for the heat exchanger flaps.

The guide plates 6 are pivoted by means of a guide plate linkage 8 which is connected, on the one hand, to the individual guide plates 6 or the axes 7 thereof, and on the other hand, through a connecting linkage 9 to one of the heat exchanger flaps 5 or to the drive thereof. FIG. 3 shows the linkages 8 and 9 and a linkage 12 for pivoting the heat exchanger flaps 6 in solid lines. The flaps pivoted by the linkages are shown in broken lines. The heat exchanger flaps 5 are driven by drive 11. The linkages 8 and 9 are arranged within the ducts 1 and 3, respectively, and the shafts or axes 7 thereof are mounted within the ducts on the walls of the ducts, so that they do not extend through the walls of the ducts. It is also possible to have bearings arranged outside of the ducts and also the linkages 8 arranged outside of the ducts.

In the position shown in FIG. 1, the heat exchanger flaps 5 are closed and the guide plates 6 are inclined against the flow of combustion gases denoted by reference numeral 10 and the guide plates 6 deflect this flow through the open bypass flap 4 into the duct 2 leading to the bypass.

In FIG. 2, the flaps have assumed the position required for heat exchanger operation. The bypass flaps 4 are closed and the heat exchanger flaps 5 are open. The guide plates 6 are in a position extending parallel to the gas flow 10 and provide virtually no resistance to this flow.

While specific embodiments of the invention have been shown and described in detail to illustrate the application of the inventive principles, it will be understood that the invention may be embodied otherwise without departing from such principles.

I claim:

1. A device at the output side of a gas turbine for conducting a flow of combustion gases into ducts leading to one of a heat exchanger and a bypass, a branching area being defined between the ducts leading to the heat exchanger and the bypass, guide plates forming guide surfaces being arranged in the branching area, wherein the guide plates can be pivoted between a first position in which the guide plates extend in longitudinal direction of the flow of combustion gases from the gas turbine to the heat exchanger and a second position which is inclined relative to the first position, a drive means for pivoting the guide plates, at least one flap being mounted in the duct leading to the heat exchanger, the at least one flap being driven by a drive means, the drive means for the guide plates being dependent on the drive means for the at least one flap, further comprising a guide plate linkage for pivoting the guide plates, and at least one connecting linkage for connecting the guide plate linkage to the at least one flap.

2. The device according to claim 1, comprising a drive means for pivoting the guide plates, at least one flap being mounted in the duct leading to the bypass, the at least one flap being driven by a drive means, the drive means for the guide plates being dependent on the drive means for the at least one flap.

3. The device according to claim 1, comprising a drive linkage for connecting the at least one connecting linkage to the at least one flap.

* * * * *